US008319807B2

(12) United States Patent
Ikuta

(10) Patent No.: US 8,319,807 B2
(45) Date of Patent: Nov. 27, 2012

(54) ELECTROPHOTOGRAPHIC IMAGE FORMING APPARATUS

(75) Inventor: Mitsuhiro Ikuta, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 247 days.

(21) Appl. No.: 12/909,447

(22) Filed: Oct. 21, 2010

(65) Prior Publication Data

US 2011/0115871 A1 May 19, 2011

(30) Foreign Application Priority Data

Nov. 18, 2009 (JP) ..... 2009-262556

(51) Int. Cl.
*G03G 13/04* (2006.01)

(52) U.S. Cl. ..... 347/134

(58) Field of Classification Search ..... None
See application file for complete search history.

(56) References Cited

FOREIGN PATENT DOCUMENTS

JP 6-024039 2/1994

*Primary Examiner* — Stephen Meier
*Assistant Examiner* — Tracey McMillion
(74) *Attorney, Agent, or Firm* — Fitzpatrick, Cella, Harper & Scinto

(57) ABSTRACT

Provided is an electrophotographic image forming apparatus using a novel array light source to replace the LED array light sources, which enables provision of a reduced image formation spot diameter on a photoreceptor as well as a reduced spot pitch. An electrophotographic image forming apparatus according to the present invention includes an electrophotographic image forming apparatus including a light source, and an electrophotographic photoreceptor to be exposed by the light source, the light source for exposing the electrophotographic photoreceptor including: a plurality of surface plasmon waveguides for forming a potential distribution on the electrophotographic photoreceptor using near-field light generated at tips thereof, the surface plasmon waveguides being arrayed: and an excitation mechanism for exciting a surface plasmon on each of the plurality of surface plasmon waveguides.

10 Claims, 7 Drawing Sheets

ELECTROPHOTOGRAPHIC IMAGE FORMING APPARATUS

BACKGROUND OF THE INVENTION

1. Field of the Invention

The present invention relates to an electrophotographic image forming apparatus.

2. Description of the Related Art

Among the electrophotographic image forming apparatuses for forming an image on a recording medium using an electrophotographic image forming process, such as copiers and printers, those that scan laser light by means of a scanning optical system to expose a photoreceptor and thereby form a latent image are currently prevailing.

Meanwhile, in recent years, as in Japanese Patent Application Laid-Open No. H06-024039, printers having a light emitting device array, which are based on an electrophotographic technique using an LED array light source, have been proposed. Such electrophotographic image forming apparatus using an LED array light source requires no scanning system (for example, a polygon mirror or a MEMS mirror), and thus, has advantages in that the apparatus causes only small noise as well as being able to be downsized.

Furthermore, although in general, scanning systems have a limitation in scanning speed, which often determines the speed for image formation, the aforementioned electrophotographic image forming apparatuses using an LED array light source, which have no scanning system, have no limitation in scanning speed, and thus, have an advantage in achieving a further increase in speed.

SUMMARY OF THE INVENTION

In recent years, there is an increasing demand for copiers and printers using the aforementioned electrophotographic image forming process to have high resolution while having a high speed in image formation. Therefore, there is also a demand for electrophotographic image forming apparatuses having an LED array light source to, e.g., have a reduced image formation spot diameter and a reduced pitch of the spots in relation to the LED array light source.

Here, under the present circumstances, in general, a reduced image formation spot means an image formation spot having a diameter of around 1 to 100 μm, although depending on the diameter of the tonner used for electrophotograph development. Also, a reduced pitch of the spots means a pitch around equal to the image formation spot diameter or no larger than the spot diameter in an image formation position in the photoreceptor.

However, provision of a reduced spot pitch in an LED array light source is not easy for the following reasons.

A lens array is needed for making light emitted from an LED array uniformly form an image on a photosensitive drum. However, since light emitted from an LED array has a certain degree of far field divergence, in order to separate light from a LED element and light from its neighboring LED element from each other, the LED elements must adequately be spaced from each other. For such reasons, where an LED array light source is used, it is difficult to provide a reduced spot pitch.

In view of the above problems, the present invention is intended to provide an electrophotographic image forming apparatus using a novel array light source to replace the LED array light sources, which enables provision of a reduced image formation spot diameter on a photoreceptor as well as a reduced spot pitch.

In view of above, an electrophotographic image forming apparatus the present invention is characterized in including a light source, and an electrophotographic photoreceptor to be exposed by the light source, the light source comprising: a plurality of surface plasmon waveguides for forming a potential distribution on the electrophotographic photoreceptor using near-field light generated at tips thereof; and an excitation mechanism for exciting a surface plasmon on each of the plurality of surface plasmon waveguides.

The present invention enables provision of an electrophotographic image forming apparatus using a novel array light source to replace the LED array light sources, which enables provision of a reduced image formation spot diameter on a photoreceptor as well as a reduced spot pitch.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

An electrophotographic image forming apparatus according to an embodiment of the present invention will be described. The electrophotographic image forming apparatus according to the present embodiment uses arrayed surface plasmon waveguides as a light source. Before describing a specific configuration of such surface plasmon waveguides, first, the principle of operation of a surface plasmon will be described. Here, a surface plasmon means a surface plasmon polariton.

A surface plasmon is an excited state on the interface between a substance filled with free electrons like a metal or a highly-doped semiconductor and a dielectric, which results from a mixture state of a vibrationally-excited state of free electrons in the substance on the interface (plasmon) and an electromagnetic field (near-field light) exuding into the dielectric (polariton).

Figure 10:
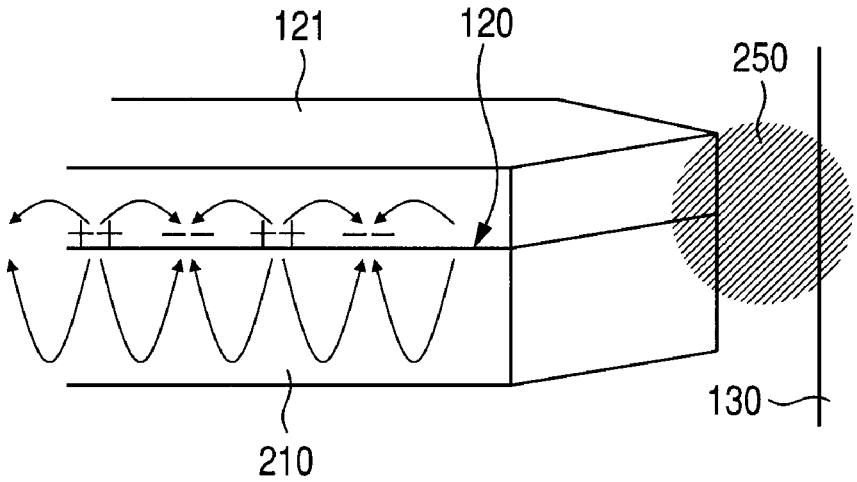
FIG. 10 is a schematic diagram illustrating a principle of operation of a surface plasmon waveguide.

FIG. 10 illustrates an example of a surface plasmon waveguide.

For a surface plasmon waveguide 120, for example, an interface in which a thin firm or fine needle-shaped metal (or highly-doped semiconductor) 121 and a dielectric 210 are adjacent to each other can be contemplated. It is known that a surface plasmon waveguide has a surface plasmon propagation mode exists even where, for example, the thin film-shaped metal in the dielectric has a small thickness or the fine needle-shaped metal in the dielectric has a small diameter. The energy of near-field light converges on a tip of a surface plasmon waveguide array in which surface plasmons are excited (for example, an edge portion 250 of the metal member 121).

In the present invention, the energy is used for exposure of an electrophotographic photoreceptor 130. Consequently, reduction of an image formation spot diameter on a photoreceptor and reduction of a spot pitch, which are demanded to the electrophotographic image forming apparatuses as described above, can be achieved.

This is because a photoreceptor is exposed using near-field light as described above, requiring no image forming optical system such as lenses, which is required where a laser or LED is used for an array light source, and thus, there is no need to take, e.g., diffusion of light due to a diffraction effect into consideration. In other words, the size of a light-converging spot of near-field light depends on the shape of a tip of a surface plasmon waveguide, and is not limited by what is called a diffraction limit. Thus, compared with the case using propagating light with the same frequency as a light source, a smaller image formation spot diameter can be provided.

Also, a waveguide that guides energy to an exposure point is a waveguide that guides a surface plasmon, which is a surface wave, as opposed to an optical waveguide. Thus, compared with the case using propagating light with the same frequency as a light source, a thinner or finer waveguide can be provided. Furthermore, the volume of an area from which the energy exudes outside the waveguide can be reduced.

Accordingly, surface plasmon waveguides can be arranged in an array with a higher density compared to optical waveguides, and consequently, enable provision of a sufficiently small pitch of image formation spots.

It is not necessarily the case that the smaller image formation spot diameter is better, there is a case where it is not necessary to provide an image formation spot diameter of no more than 10 μm. This is because the diameter of toner used for image development is around several micrometers and humans have limited spatial resolution in their visibilities.

Figure 11A:
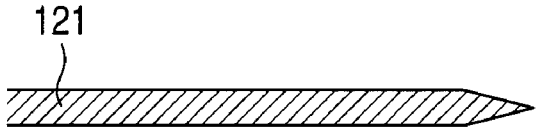
FIGS. 11A and 11B are schematic diagrams each illustrating an example of a shape of a tip of a surface plasmon waveguide.
Figure 11B:
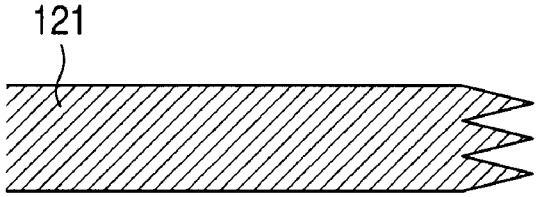

The shape of tips of the surface plasmon waveguides is designed so as to obtain a demanded near-field light profile. For example, as illustrated in FIG. 11A, where each surface plasmon waveguide has one sharpened tip, a latent image with sharp dots can be formed on a photoreceptor. Meanwhile, as illustrated in FIG. 11B, each surface plasmon waveguide has a plurality of sharpened tips, a latent image with smooth dots can be formed on a photoreceptor. In many cases, the former is suitable for characters and the latter is suitable for images such as photographs.

The number of waveguides in the arrayed surface plasmon waveguides is, for example, no less than 10000.

Also, the pitch of the respective tips of the arrayed surface plasmon waveguides is, for example, no more than 20 μm. A proper arrangement of such surface plasmon waveguides enables formation of an image with, e.g., a resolution of no less than 1200 dpi in a distance of a short side of an A4-size paper (210 mm) on a photoreceptor.

Furthermore, in an LED array, in order to make light emitted from an LED form an image in a spot with a certain degree of smallness, an available light source optical frequency of a light source is limited to those in the near-infrared range or larger in reality considering the diffraction effect. Meanwhile, the spot diameter of near-field light depends on the geometrical shape of the surface plasmon waveguide, and has no conception of diffraction limit such as that in propagating light, such as laser and LED.

In the present invention, the use of near-field light for exposure of a photoreceptor enables exposure with the image formation spot diameter reduced to some extent to be performed using not only light in a frequency band of near-infrared light or larger, but also light in a frequency band of, e.g., terahertz or far-infrared light. For example, light with a frequency of no less than 30 THz and no more than 400 THz (what is called infrared light) can be used.

Where light in a long-wavelength frequency band is used, the S/N (signal/noise ratio) of an image formed may be improved by providing a cooling mechanism to, e.g., the photoreceptor.

In exposure for an electrophotograph, the charge amount, that is, potential distribution of a photoreceptor varies depending on the number of photons, which affects the contrast of an image formed. If the light frequency of the light source can be lowered, light energy necessary for exposure can be reduced in terms of the number of photons necessary for an image with the same density, resulting in that heat generation in the apparatus can be reduced. This can be led to heat generation reduction and energy conservation in the apparatus.

In reality, considering a demanded spot diameter and a demanded spot pitch, the distance between surface plasmon waveguides, a tip shape of waveguides, the distance between the waveguides and the photoreceptor, and the frequency of surface plasmons can be selected. The frequency can be selected from a range of, for example, 1 THz to 1 PHz. For the photoreceptor, for example, an organic photo conductor (OPC) or amorphous Si can be used. For a charging mechanism for the photoreceptor, a non-linear process (charge is generated by multi-photon absorption) can be used.

In the embodiment of the present invention, surface plasmon waveguides such as described above are arrayed and used as a light source included in an electrophotographic image forming apparatus.

In such case, the surface plasmon array used in the present embodiment is required to provide a contrast in an image in exposure using near-field light therefrom, and thus, the surface plasmon array can be configured to individually perform intensity modulation of the respective surface plasmon waveguides in the surface plasmon array.

Here, the modulation include two-phase (i.e., on/off) modulation and multiphase modulation.

There are two methods for the modulation: the modulation is performed on excitation mechanisms for surface plasmons and a modulation mechanism is provided to each waveguide separately from the excitation mechanism. A method of combination of the above two methods may also be employed.

EXAMPLES

Examples of the present invention will be described below.

Example 1

An example configuration of an electrophotographic image forming apparatus using a near-field light source including surface plasmon waveguides as a light source will be described as example 1. First, a basic configuration of a near-field light source including surface plasmon waveguides in the present example will be described using a schematic diagram in FIG. 1. In the present example, excitation sources that can individually modulate the excitation intensities of the surface plasmon waveguides are provided.

Figure 1:
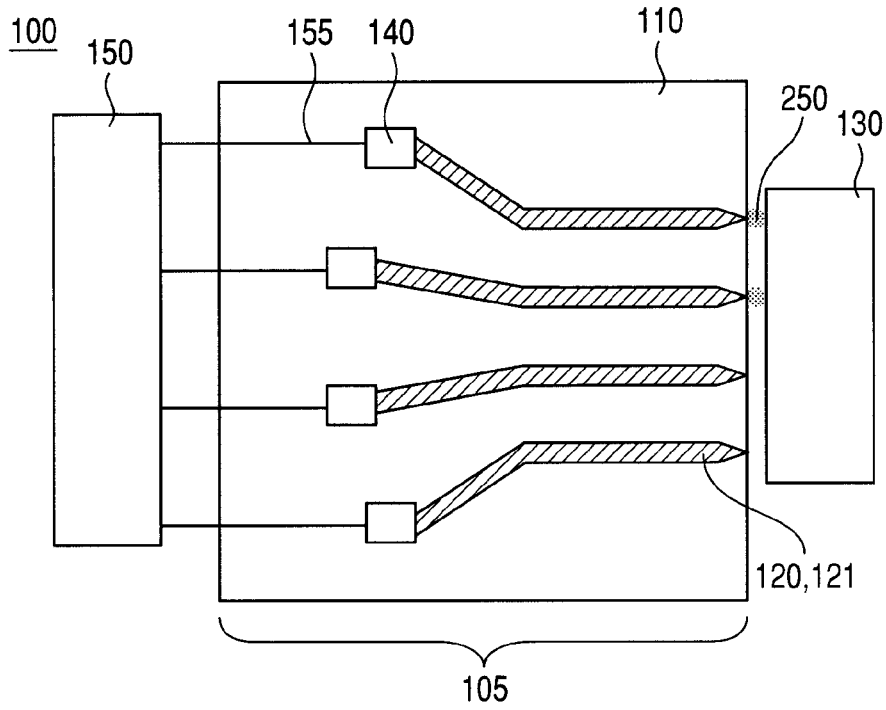
FIG. 1 is a schematic diagram illustrating a basic configuration of a near-field light source including surface plasmon waveguides in example 1.

In FIG. 1, an electrophotographic image forming apparatus 100 according to the present example includes a plurality of surface plasmon waveguides 120 arranged on a substrate 110 in a near-field light source 105. The apparatus is configured so that in each surface plasmon waveguide 120, a plasmon is excited and propagates on a surface included in the interface between a metal thin wire 121 and the dielectric substrate 110.

Also, an electrophotographic photoreceptor 130 is provided around tips of the surface plasmon waveguides 120.

When a surface plasmon is excited on each surface plasmon waveguide 120 by an excitation source (excitation mechanism) 140 individually provided for each surface plasmon waveguide 120, a near-field light spot 250 in which energy locally converges is generated at a tip of the surface plasmon waveguide 120. The near-field light exposes the electrophotographic photoreceptor 130 to form a potential distribution in the electrophotographic photoreceptor 130.

Each excitation source 140 is connected to a drive circuit 150 via a wiring 155. The drive circuits 150 can individually modulate the excitation intensities of the respective excitation sources 140. Accordingly, the drive circuits 150 can also modulate the intensities of the respective near-field light spots 250. Examples of a method for an excitation source 140 to excite a surface plasmon on a surface plasmon waveguide 120 include an excitation method using light, and an excitation method using an electronic beam. For the light, for example, laser light, or light output from an LED can be used. Examples of a surface plasmon excitation method includes an excitation method using total reflection evanescent light, which is known as attenuated total reflection (ATR).

Figure 2:
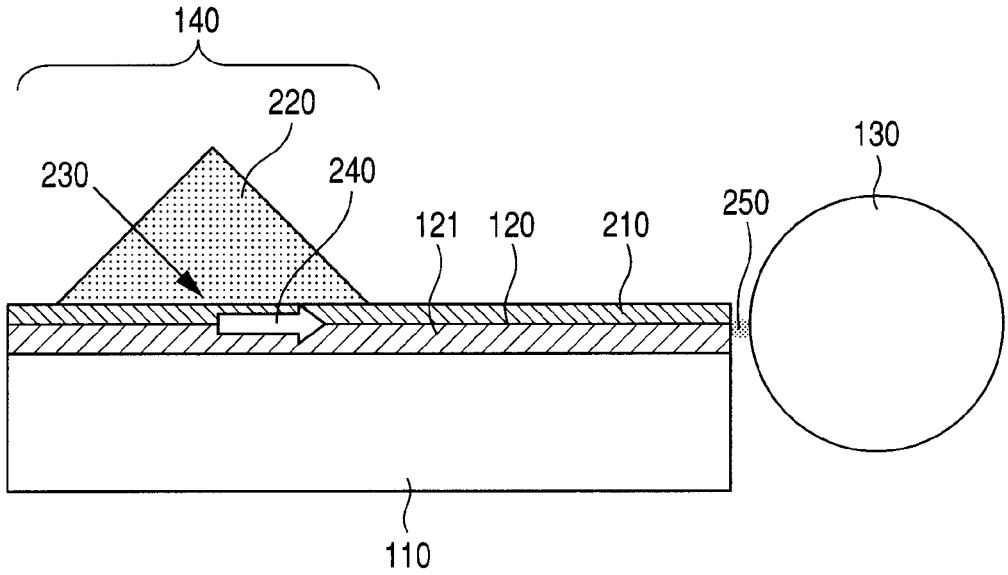
FIG. 2 is a schematic cross-sectional diagram illustrating an example of a surface plasmon waveguide and an excitation mechanism in example 1.

Next, an example of a surface plasmon waveguide and an excitation mechanism in the present example will be described. FIG. 2 is a schematic cross-sectional diagram of a surface plasmon waveguide and an excitation mechanism using a configuration known as an Otto configuration in ATR.

As illustrated in FIG. 2, an excitation mechanism in the present example includes a substrate 110, a metal thin wire 121 formed on the substrate 110, the metal thin wire 121 including, for example, gold, and a surface plasmon waveguide 120 including an interface between the metal thin wire 121 and a dielectric film 210 arranged on the metal thin wire 121 so as to cover the metal thin wire 121, the dielectric film 210 including, for example, $SiO_2$.

On the dielectric film 210, for example, a glass total reflection prism 220 is disposed.

The width of the metal thin wire is, for example, several micrometers. The thicknesses of the metal thin wire and the dielectric are around several tens of nanometers. When excitation light 230 enters the interface between the dielectric and the waveguide from the prism 220 side at a predetermined angle exceeding a total reflection angle, a surface plasmon 240 according to the frequency of the excitation light is excited. Here, the intensity of the surface plasmon 240 to be excited can be modulated by modulating the intensity of the excitation light 230.

The excited surface plasmon 240 propagates through the surface plasmon waveguide 120 and exposes an electrophotographic photoreceptor 130.

The surface plasmon waveguide 120 has a tip processed so as to have a shape allowing a near-field light spot 250 in which energy converges to easily expose the electrophotographic photoreceptor 130, for example, a sharp-pointed shape.

In example 1, what is called a Kretschmann configuration in which the positions of the metal thin wire 121 and the dielectric film 210 illustrated in FIG. 2 are interchanged and the surface plasmon waveguide 120 is interposed between the prism 220 and the dielectric film 210 can also be employed.

Next, another example of a surface plasmon waveguide and an excitation mechanism in the present example will be described with reference to FIG. 3. The excitation mechanism in FIG. 3 is configured so as to form a diffraction grating in the surface plasmon waveguide, combine a propagation mode of the surface plasmon waveguide and a radiation mode outside the surface plasmon waveguide, and input excitation light to the radiation mode to excite a surface plasmon.

Figure 3:
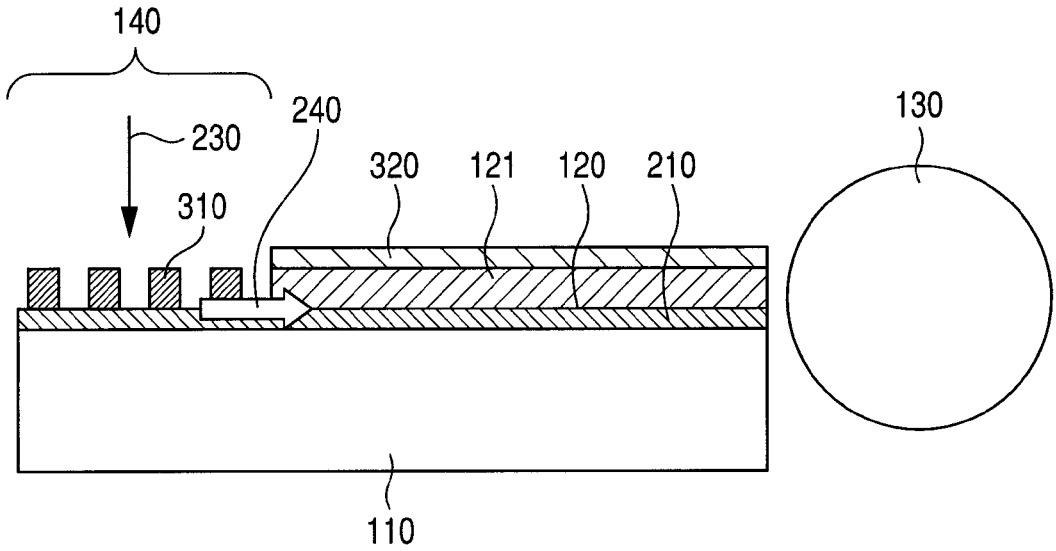
FIG. 3 is a schematic cross-sectional diagram illustrating another example of a surface plasmon waveguide and an excitation mechanism in example 1.

As illustrated in FIG. 3, an excitation mechanism in the present example includes a substrate 110, and a dielectric film 210 formed on the substrate, the dielectric film 210 including, for example, $SiO_2$. The excitation mechanism further includes a surface plasmon waveguide 120 including a metal thin wire 121 arranged on the dielectric film 210, the metal thin wire 121 including, for example, gold, and a protection film 320 arranged on the metal thin wire 121.

A diffraction grating 310 is formed in the surface plasmon waveguide 120 (metal thin wire 121). When excitation light 230 enters the diffraction grating at a predetermined angle, a surface plasmon 240 is excited between the surface plasmon waveguide 120 and the dielectric film 210. Here, the predetermined angle may be an angle determined depending on the structure of the diffraction grating 310 in addition to the wavelength of the excitation light 230 and the materials of the metal thin wire 121 and the dielectric film 210, and the diffraction grating 310 is designed so that the predetermined angle is, for example, 0°.

Next, an example of an electrophotographic image forming apparatus 100 using a near-field light source 105 in the present example will be described with reference to FIG. 4.

Figure 4:
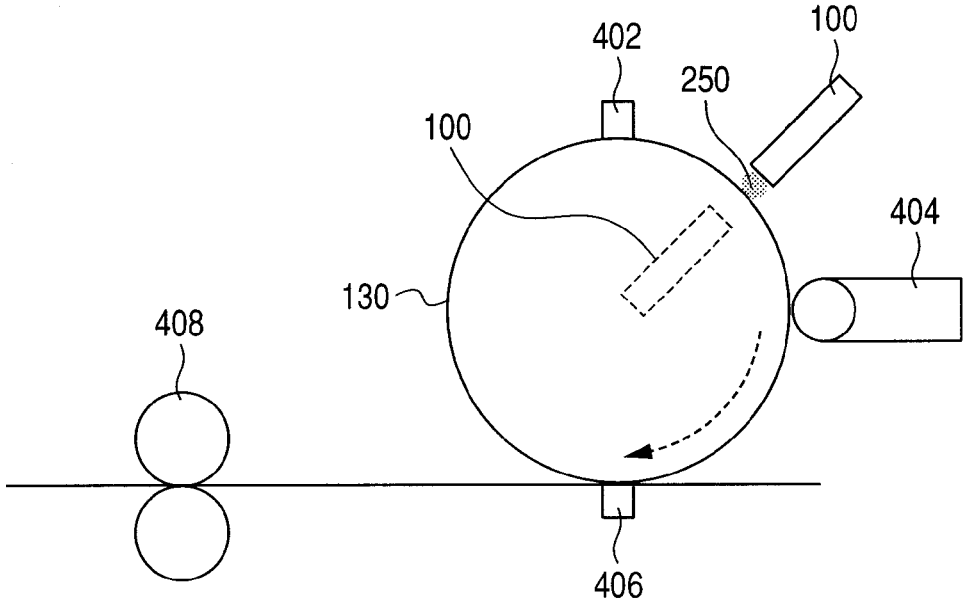
FIG. 4 is a side view of a structure of an electrophotographic image forming apparatus using a near-field light source in example 1.

FIG. 4 illustrates a photoreceptor (cylindrical photosensitive drum) 130, a charger 402, a developing mechanism 404, a transfer charger 406 and a fuser mechanism 408. The near-field light source 105 is a light source for recording, and is configured so as to be turned on/off according to an image signal from an excitation source 140 (not illustrated). A near-field light 250 whose intensity has been modulated as described above is applied to the photosensitive drum 130.

A near-field light source includes an array in a cylinder axis direction. The near-field light source 105 in the present example includes a surface plasmon waveguide array including no less than 10000 surface plasmon waveguides, and can form no less than 10000 pixels simultaneously. The array pitch for the surface plasmon waveguide array is, for example, several micrometers.

A plurality of near-field light sources 105 can also be arranged. In this case, an arrangement is made so that a surface plasmon waveguide array in a near-field light source exposes a space between spots on the drum that are exposed by a surface plasmon waveguide array in another near-field light source, enabling provision of a finer image.

The photosensitive drum 130 is charged in advance by the charger 402 and is exposed by the near-field light of the near-field light source 105, and an electrostatic latent image is formed thereon. Also, the photosensitive drum 130 rotates in the arrow direction, a formed electrostatic latent image is developed by the developing mechanism 404, and the developed visible image is transferred onto transfer paper (not illustrated) by the transfer charger 406.

The transfer paper with the visible image transferred thereon is conveyed to the fuser mechanism 408, and fusing is performed there. Then, the transfer paper is ejected to the outside of the apparatus.

As described above, configuration of an electrophotographic image forming apparatus using the near-field light source including the surface plasmon waveguide array according to the present invention enables provision of an electrophotographic image forming apparatus enabling high-speed, high-definition printing.

Although in the above description in the present example, the near-field light source 105 is arranged outside the photosensitive drum 130, the near-field light source 105 can be arranged inside the photosensitive drum 130.

Example 2

Figure 5:
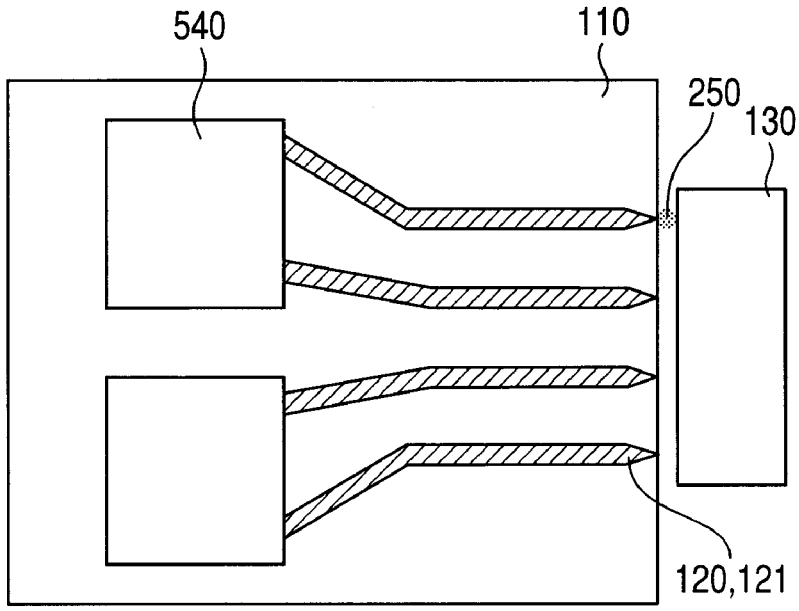
FIG. 5 is a schematic diagram illustrating a basic structure of a near-field light source including surface plasmon waveguides in example 2.

An example of a configuration in which an excitation source has a configuration that is different from that of example 1 will be described using a schematic diagram in FIG. 5 as an example 2. The present example is different from example 1 only in that one excitation source is provided for a plurality of surface plasmon waveguides and individually excites the plurality of surface plasmon waveguides, and the rest of the configuration is basically the same. In other words, in the present example, surface plasmon waveguides 120 are arranged on a substrate 110 as illustrated in FIG. 5.

Also, example 2 is similar to example 1 in that an electrophotographic photoreceptor 130, which is exposed by near-field light spots 250 generated around tips of the surface plasmon waveguides 120, is provided.

The present example, as opposed to example 1, is configured so that a plurality of surface plasmon waveguides 120 are individually excited by a single excitation source 540. The excitation source 540 can include, for example, a laser scanner.

Example 3

Figure 6:
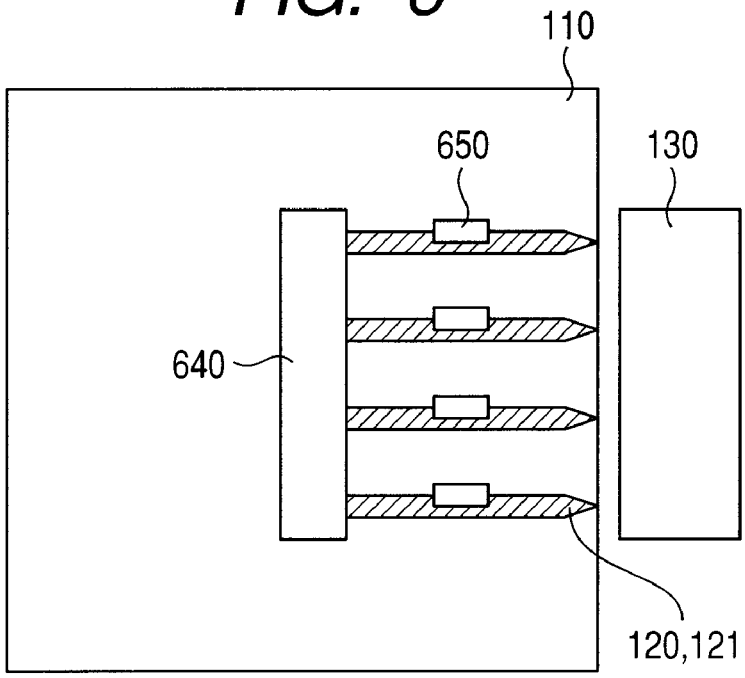
FIG. 6 is a schematic diagram illustrating a basic configuration of a near-field light source including surface plasmon waveguides in example 3.

An example of a configuration in which a modulation mechanism 650 is provided to each surface plasmon waveguide 120 separately from an excitation source 640 that excites a surface plasmon on the respective waveguides will be described with reference to a schematic diagram in FIG. 6 as example 3.

Here, examples of the modulation mechanism include a mechanism that changes the permittivity of a plasmon waveguide or a medium around the plasmon waveguide by heat to modulate a propagation loss of the plasmon waveguide. The examples also include a mechanism that performs mechanical modulation on a plasmon waveguide or a medium around the plasmon waveguide to modulate a propagation loss. For such mechanism, e.g., a mechanism that modulates a plasmon waveguide mode by means of a spatial movement of a substance around the waveguide can be used.

Alternatively, a mechanism that mechanically deforms or distorts a plasmon waveguide or a medium around the plasmon waveguide to change a refractive index distribution, thereby modulating a plasmon waveguide mode can be used.

Furthermore, the examples include a mechanism that modulates a propagation loss by means of electric or magnetic modulation. For such mechanism, for example, a mechanism that provides an electric field or a magnetic field to a plasmon waveguide or a medium around the plasmon waveguide to change the electron distribution on the waveguide, thereby modulating a propagation loss in a plasmon waveguide mode can be used.

Also, the examples include a mechanism that modulates a propagation loss by means of optical modulation. For such mechanism, for example, a mechanism in which an optical gain medium is provided to a part of the surroundings of a plasmon waveguide to modulate a gain from the optical gain medium can be used. For the optical gain medium, for example, a quantum well structure using a pn conjunction of a semiconductor can be used.

The aforementioned optical gain is set so that a gain is obtained in the frequency of a surface plasmon excited in a plasmon waveguide. For example, in the case of a quantum well structure, an optical gain is modulated by modulating an amount of carriers poured into a quantum well, enabling modulation of a propagation loss of a surface plasmon waveguide. In this case, a stimulated emission phenomenon can be used.

Use of the above-mentioned modulation mechanisms 650 enables modulation of the energy intensities of near-field spots at the respective surface plasmon waveguide tips even though the excitation source 640 does not necessarily individually modulate the surface plasmon waveguides when exciting the surface plasmon waveguides.

Other Configuration Examples

Although in the foregoing examples, a metal thin wire 121 included in a surface plasmon waveguide is provided on a substrate 110, a metal thin wire 121 may be embedded in a substrate as far as the metal thin wire 121 functions as a waveguide for a surface plasmon.

Figure 7A:
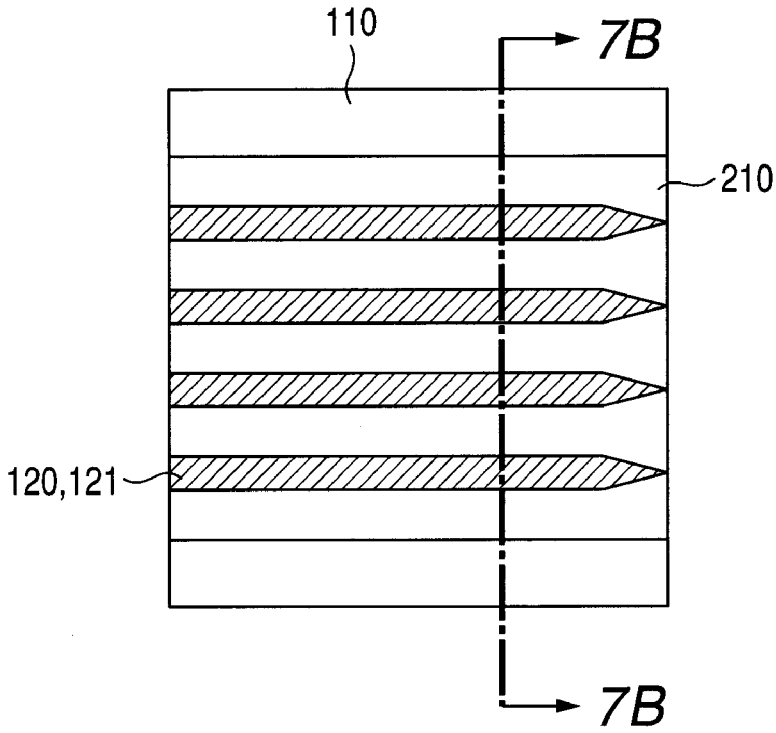
FIGS. 7A and 7B are schematic diagrams illustrating in a structure in which metals are embedded in a dielectric other than a substrate and interfaces between the metals and the dielectric are used as plasmon waveguides in another configuration example.
Figure 7B:
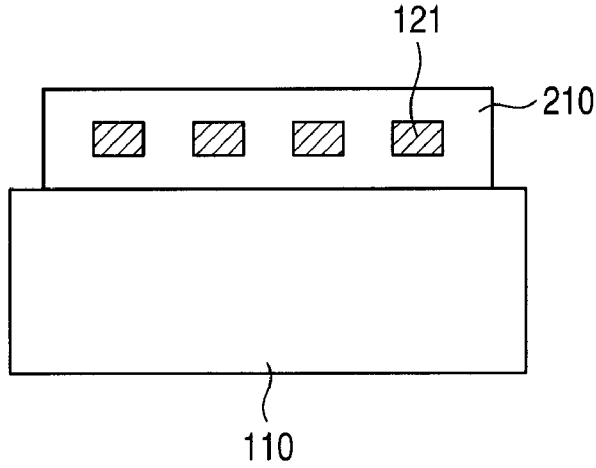

Also, not only an interface between a substrate or a dielectric, and a metal provided thereon is used as a plasmon waveguide, but also a structure in which a metal 121 is embedded in a dielectric 210 other than the substrate to use an interface between the metal 121 and the dielectric 210 as a plasmon waveguide may be employed as illustrated in FIGS. 7A and 7B. Here, FIG. 7B illustrates a cross section of the structure in FIG. 7A along dashed line 7B-7B.

Also, a substrate surface and an array emission surface are not necessarily perpendicular to each other, and may be, for example, in parallel to each other.

Figure 8:
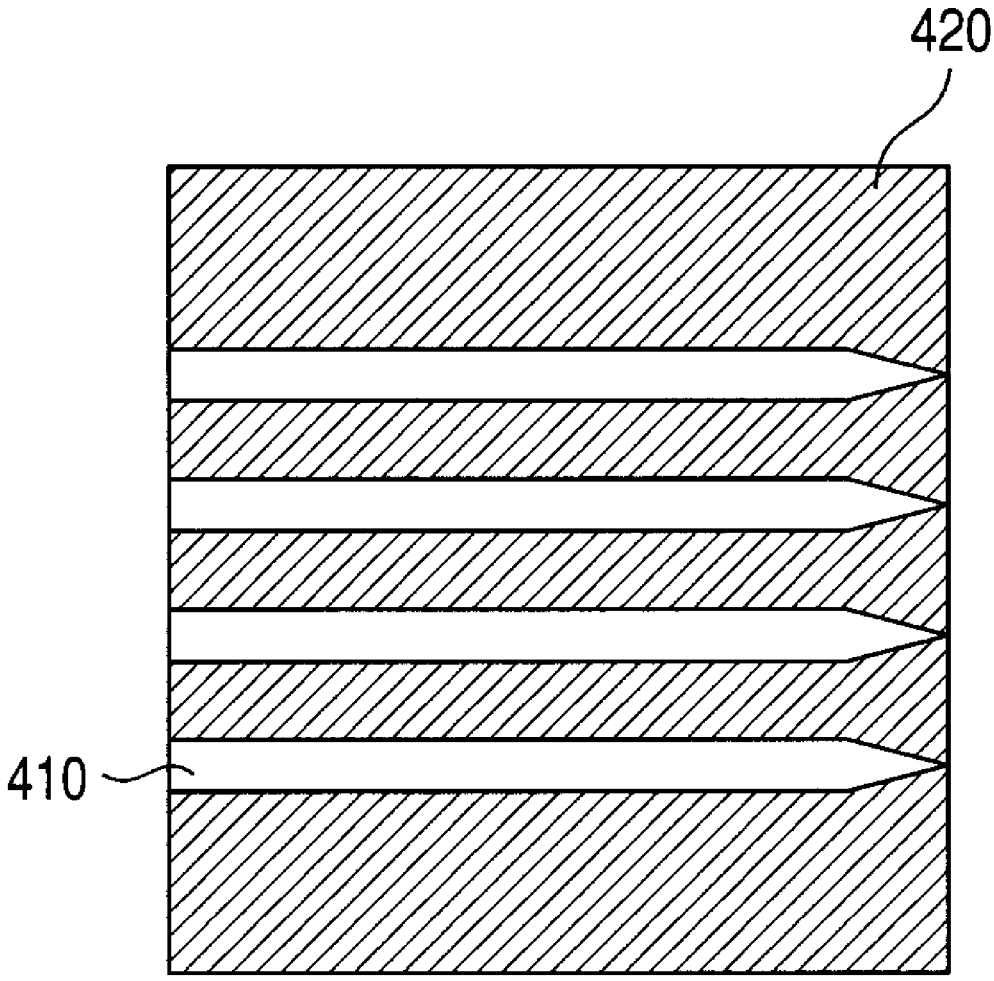
FIG. 8 is a schematic diagram illustrating a configuration of a surface plasmon waveguides in which pointed dielectrics are included in a metal in another configuration example.

For surface plasmon waveguides, besides those prepared by including sharp-pointed metals 121 in a dielectric substrate 110, those prepared by including sharp-pointed dielectrics 410 in a metal 420 may be employed as illustrated in FIG. 8.

Figure 9A:
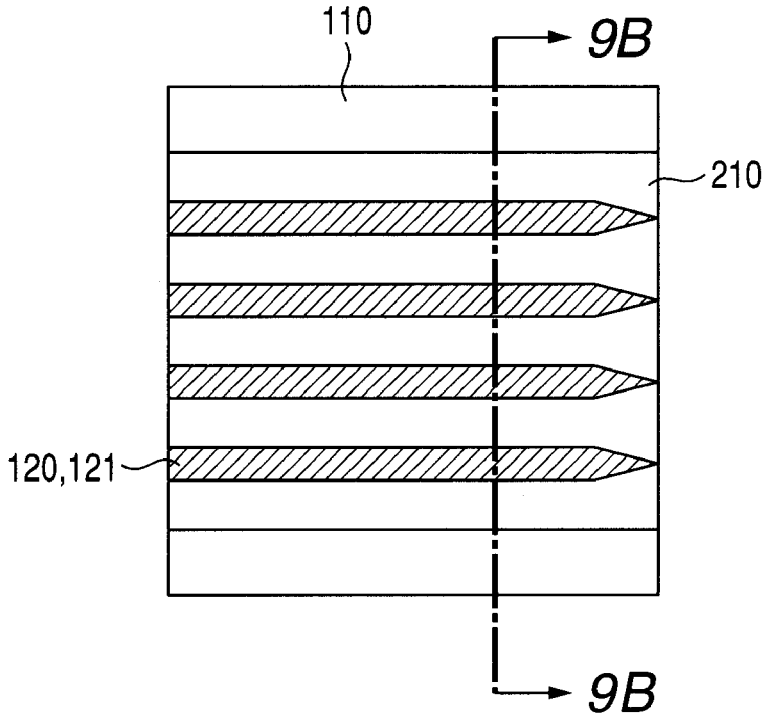
FIGS. 9A and 9B are schematic diagrams illustrating a configuration of an array of surface plasmon waveguides having a multilayered structure in another configuration example.
Figure 9B:
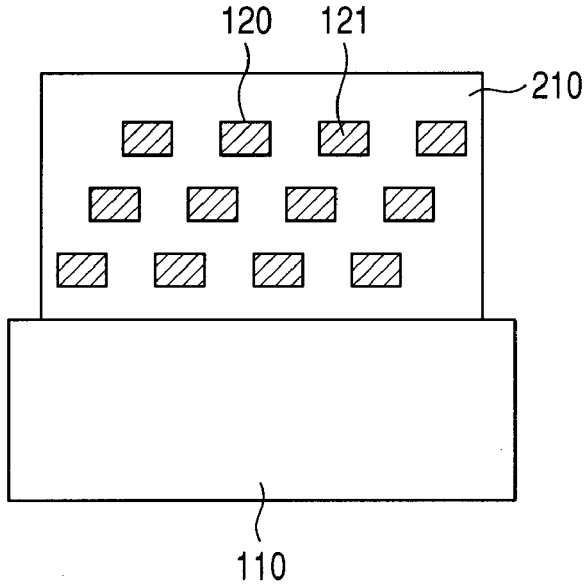

Furthermore, an array of surface plasmon waveguides 120 may have a multilayered structure as illustrated in FIGS. 9A and 9B. Here, FIG. 9B illustrates a cross section of the structure in FIG. 9A along dashed line 9B-9B.

Also, the above-described photoreceptor may have a cylindrical shape, and the electrophotographic image forming apparatus 100 may be provided not outside but inside the cylinder as shown by dashed line in FIG. 4.

In such case, a toner receiving surface of the photoreceptor and a surface of the photoreceptor exposed by the plasmon waveguides are opposite to each other, providing an advantage in that toner hardly adheres to the plasmon waveguides.

Also, the image forming apparatus may include a mechanism that monitors the intensity of a surface plasmon excited by a plasmon waveguide and feeds the monitored intensity back to the modulation mechanism.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-262556, filed Nov. 18, 2009, which is hereby incorporated by reference herein in its entirety.

What is claimed is:

1. An electrophotographic image forming apparatus including a light source, and an electrophotographic photoreceptor to be exposed by the light source, the light source comprising:

a plurality of surface plasmon waveguides for forming a potential distribution on the electrophotographic photoreceptor using near-field light generated at tips thereof; and an excitation mechanism for exciting a surface plasmon on each of the plurality of surface plasmon waveguides.

2. The electrophotographic image forming apparatus according to claim 1, wherein each of the surface plasmon waveguides includes a metal or a semiconductor, and a dielectric.

3. The electrophotographic image forming apparatus according to claim 1, wherein a pitch of the tips of the surface plasmon waveguides is no more than 20 μm.

4. The electrophotographic image forming apparatus according to claim 1, wherein the tip of each of the surface plasmon waveguides includes a plurality of sharpened tips.

5. The electrophotographic image forming apparatus according to claim 1, wherein the excitation mechanism includes an excitation mechanism for exciting a surface plasmon using light.

6. The electrophotographic image forming apparatus according to claim 1, wherein for the excitation mechanism, one excitation mechanism is provided for each of a plurality of surface plasmon waveguides or for the plurality of surface plasmon waveguides.

7. The electrophotographic image forming apparatus according to claim 1, wherein the excitation mechanism includes a mechanism for individually modulating excitation intensities for the plurality of surface plasmon waveguides.

8. The electrophotographic image forming apparatus according to claim 7, wherein the mechanism for individually modulating excitation intensities includes a mechanism for changing refractive index distributions for the surface plasmon waveguides, the mechanism being included in the excitation mechanism.

9. The electrophotographic image forming apparatus according to claim 7, wherein the mechanism for individually modulating excitation intensities includes a mechanism, provided for each of the plurality of surface plasmon waveguides separately from the excitation mechanism, for modulating a propagation loss for the surface plasmon waveguide.

10. The electrophotographic image forming apparatus according to claim 1, wherein the electrophotographic photoreceptor has a cylindrical shape, and the plasmon waveguides are included inside the electrophotographic photoreceptor.

* * * * *